US006511937B1

(12) United States Patent
Bearden, Jr. et al.

(10) Patent No.: US 6,511,937 B1
(45) Date of Patent: Jan. 28, 2003

(54) COMBINATION SLURRY HYDROCONVERSION PLUS SOLVENT DEASPHALTING PROCESS FOR HEAVY OIL UPGRADING WHEREIN SLURRY CATALYST IS DERIVED FROM SOLVENT DEASPHALTED ROCK

(75) Inventors: Roby Bearden, Jr., Baton Rouge, LA (US); Zhiguo Hou, Baton Rouge, LA (US); Martin Leo Gorbaty, Westfield, NJ (US); David Thomas Ferrughelli, Flemington, NJ (US); Ronald Damian Myers, Calgary (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 94 days.

(21) Appl. No.: 09/678,510

(22) Filed: Oct. 3, 2000

Related U.S. Application Data

(60) Provisional application No. 60/159,043, filed on Oct. 12, 1999.

(51) Int. Cl.[7] ..... B01J 21/18; B01J 23/00; B01J 23/40; C10C 3/00; C10G 1/00

(52) U.S. Cl. ..... 502/180; 502/182; 502/185; 208/309; 208/417; 208/427

(58) Field of Search ..... 502/180, 182, 502/185; 208/309, 417, 427

(56) References Cited

U.S. PATENT DOCUMENTS

| | | | | |
|---|---|---|---|---|
| 3,617,481 A | * | 11/1971 | Voorhies et al. | 208/50 |
| 3,622,498 A | | 11/1971 | Stolfa et al. | 208/108 |
| 3,785,958 A | | 1/1974 | Gleim et al. | 208/87 |
| 3,923,635 A | | 12/1975 | Schulman et al. | 208/50 |
| 4,110,398 A | | 8/1978 | Selvidge et al. | 423/62 |
| 4,124,486 A | | 11/1978 | Nolley, Jr. | 208/95 |
| 4,169,038 A | | 9/1979 | Metrailer et al. | 208/10 |
| 4,178,227 A | | 12/1979 | Metrailer et al. | 208/50 |
| 4,204,943 A | | 5/1980 | Metrailer et al. | 208/50 |
| 4,358,365 A | | 11/1982 | Hutchings et al. | 208/96 |
| 4,461,699 A | | 7/1984 | Eilers et al. | 208/89 |
| 4,591,426 A | | 5/1986 | Krasuk et al. | 208/96 |
| 4,592,827 A | | 6/1986 | Galiasso et al. | 208/59 |
| 5,124,025 A | * | 6/1992 | Kolstad et al. | 208/309 |
| 5,258,117 A | * | 11/1993 | Kolstad et al. | 208/309 |
| 5,807,478 A | | 9/1998 | Myers et al. | 208/370 |

FOREIGN PATENT DOCUMENTS

| | | | |
|---|---|---|---|
| AU | 8935260 A | 3/1990 | |
| CA | 1193217 | 9/1985 | C10G/49/04 |
| CA | 2175437 | 11/1996 | C10M/67/04 |
| EP | 0090441 | 9/1985 | C10G/69/06 |
| JP | 59086689 A | 5/1984 | |
| JP | 85033152 B | 8/1985 | |

OTHER PUBLICATIONS

"Characterization of Asphaltene Cracked Oils by Catalytic Hydrotreating", Akiyoshi Tamaki, et al., Research Department, Research and Development Center, Chiyoda Chemical Enginering and Construction Company, Ltd., Yokohama, Japan; given at the Symposium on Charaterization of Heavy Ends in Petroleum, Presented before the Division of Petroleum Chemistry, Inc., American Chemical Society, New York Meeting, Aug. 23–28, 1981, pp 803–815.

(List continued on next page.)

*Primary Examiner*—Mark L. Bell
*Assistant Examiner*—Patricia L. Hailey
(74) *Attorney, Agent, or Firm*—Estelle C. Bakun; Erika Singleton Wilson

(57) ABSTRACT

The invention described herein is directed to (a) slurry hydroprocessing (SHP) of a feed under SHP conditions; (b) deasphalting, under deasphalting conditions the product obtained from said step (a) and recovering a solvent deasphalted oil and solvent deasphalted rock; (c) calcining said solvent deasphalted rock at a temperature of ≦about 1200° F. to produce an ash catalyst precursor; (d) recycling said ash catalyst precursor to said step (a).

15 Claims, 1 Drawing Sheet

OTHER PUBLICATIONS

"New Developements in Deep Hydroconversion of Heavy Oil Residues with Dispersed Catalysts. 2. Kinetic Aspects of Reaction", A Del Bianco, et al., Eniricerche, S.p.A. and EURON, S.p.A., Universita di Milano, Milan, Italy; Energy & Fuels 1994, vol. 8, N.3, pp. 593–597 (May–Jun., 1994).
"New Developments in Deep Hydroconversion of Heavy Residues with Dispersed Catalysts"; Part 2: Effect of Severity on Products Yield and Quality, A. Del Bianco, et. al., Italy; Symposium on Resid Upgrading Presented before the Division of Petroleum Chemistry, Inc., 205th National Meeting, American Chemical Society, Denver Meeting, Mar. 28–Apr. 2, 1993; pp. 407–412.
[Residuum] Upgrading Activity of Recycled Mo–Based Dispersed Catalysts, A. Del Bianco, et.al., Eniricherche S.p.A. and Snamprogetti S.p.A., Milan, Italy; International Symposium on Advances in Catalysis and Processes for Heavy Oil Conversion Presented Before the Division of Petroleum Chemistry, Inc., 213th National Meeting, American Chemical Society, San Francisco, CA, Apr. 13–17, 1997; pp. 484–488.
"Cogeneration Refinery for Total Residue Destruction", G. L. Farina, et. al, Foster Wheeler Italiana, Milan, Italy; Hydrocarbon Processing, vol. 72 N. Nov. 11, 1993, pp. 52–54, 56.
"Solvent De–ashing from Heavy Product of Brown Coal Liquefaction Using Toluene, 1. Solubility of Heavy Products and Settling Velocity of Ash", Osamu Okuma, et al., Chemical, Polymer, Bio, Technology Laboratory, and Takasago Research Laboratory, Kobe Steel Ltd., and Nippon Brown Coal Liquefaction Co., Ltd., Japan; Elsevier Fuel Processing Technology, vol. 51, N.3 (Oct., 1997), pp. 177–193.
"Refining High–Sulfur Crude Oil to Low–Sulfur Products", R. O. Skamser, C. F.Braun & Company; 90th AICHE National Meeting, Houston, Texas, Apr. 5–9, 1981, Prepr. N. 25A 12P.

"Characterizaiton of Asphaltene Craked Oils by Catalytic Hydrotreating", A. Tamaki, et.al., Chiyoda Chemical Engineering Construction Company, Ltd.; 182nd ACS National Meeting (New York), Aug. 23–28, 1981, ACS Divsion of Petroleum Chem. Prepr., vol. 26, N.4, pp. 803–815 (Sep., 1981).

"Upgrading of Petrolem Residues, Bitumen, and Shale Oil/ The HDH Process for Upgrading of Heavy Venezuelan Crudes", F.; Silva, et al., Intevep S.A., 11th World Petroleum Congress, (London, Aug. 28–Sep. 2, 1983) Prepr. N. RTD4 (2) 10P.

"[A discussion of] Other Intevep S.A. Processes for Upgrading Heavy Crude Oils and Residua", R. Galiasso, Intevep, S.A.; La Revista Tecnica de INTEVEP S.A., vol. 9, N.2 pp. 147–162 (Jul.–Dec., 1989) (Abstract).

"Catalytic Processing of Heavy Residues: An Overview", H. Qabazard, et. al., Oklahoma State University, University of Oklahoma; Kuwait Institute for Scientific Research, et.al. "Catalysts in Petroleum Refining" Conference (Kuwait, Mar. 5–8, 1989) Studies in Surface Science and Catalysis . . . Catalysts in Petroleum Refining, 1989, vol. 53, pp. 61–75 (1990).

* cited by examiner

FIGURE
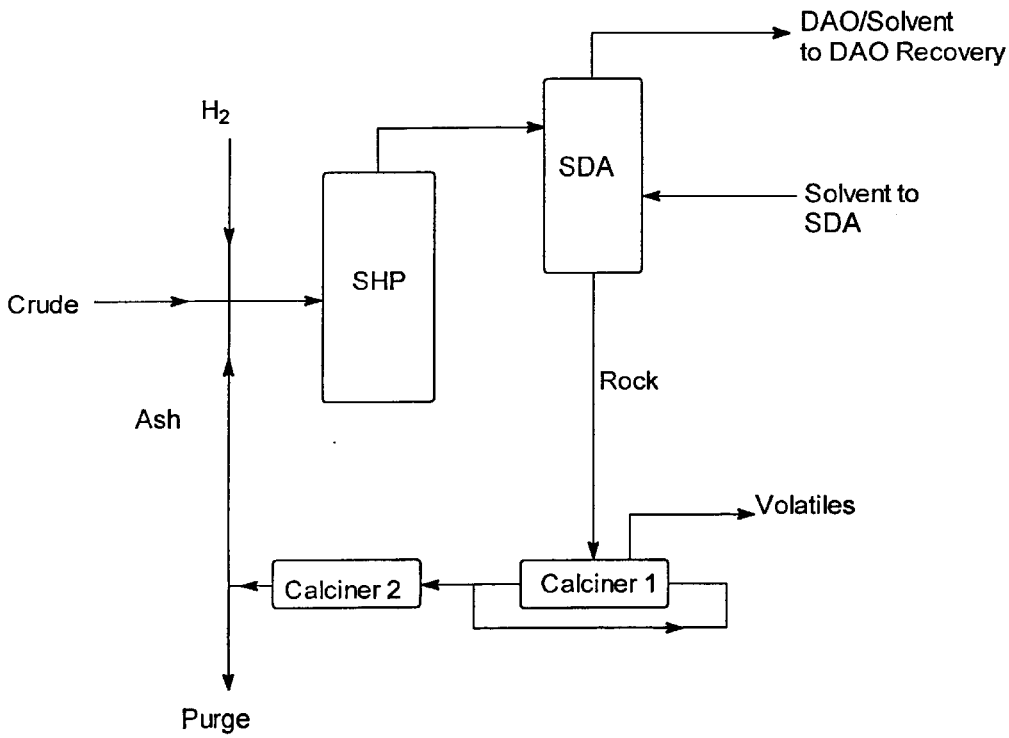

COMBINATION SLURRY HYDROCONVERSION PLUS SOLVENT DEASPHALTING PROCESS FOR HEAVY OIL UPGRADING WHEREIN SLURRY CATALYST IS DERIVED FROM SOLVENT DEASPHALTED ROCK

This application claims the benefit of Provisional application Ser. No. 60/159,043, filed Oct. 12, 1999.

FIELD OF THE INVENTION

An embodiment of the instant invention is directed to an integrated combination of a slurry hydroprocessing (SHP) process in combination with a solvent deasphalting process.

BACKGROUND OF THE INVENTION

There is a need in the industry for increased capacity for processing heavy crudes and residua. Moreover, lower cost upgrading technology is needed to enhance the marketability and value of enormous supplies of heavy crudes. Thus enhancements to deasphalting processes would be beneficial to the industry.

Slurry hydroprocessing (SHP) is a technology capable of providing a low cost means for upgrading heavy crudes. U.S. Pat. No. 5,807,478 describes a method for lowering the viscosity and specific gravity of a heavy hydrocarbon to render it pipelineable comprising adding a vanadium and nickel containing coke fly ash to the heavy hydrocarbon and reacting with a molecular hydrogen containing gas under hydroconversion conditions for a time sufficient to lower the viscosity of the heavy hydrocarbon.

Other patents exist in the literature which deal with hydrotreating followed by solvent deasphalting. For example, U.S. Pat. No. 4,591,426 to Krasuk et al describes a process for upgrading feedstocks containing not less than about 200 ppm metals, an API gravity of less than about 20°, and a Conradson Carbon of more than about 8%, by hydroconversion with hydrogen in the presence of naturally occurring inorganic material as catalyst. The invention further provides for subsequent fractionation of the hydroconverted product and solvent deasphalting the distillation bottoms and optionally hydrodesulfurizing the atmospheric distillates and the mix of vacuum gas oils and deasphalted oils separately.

U.S. Pat. No. 4,358,365 describes a process for the conversion of an asphaltene-containing hydrocarbonaceous black oil in a catalytic slurry reaction zone where an admixture of converted hydrocarbonaceous oil and unconverted asphaltenes are recycled to the reaction zone.

U.S. Pat. No. 4,124,486 describes conversion of asphaltene-containing stocks and product separations. The technique can be integrated into a catalytic slurry process.

U.S. Pat. No. 3,622,498 describes a slurry process for black oil conversion.

U.S. Pat. No. 4,461,699 describes a process for producing a heavy oil with a low Ramsbottom carbon test from a long resid by a two-stage process comprising catalytic hydrotreatment followed by solvent deasphalting and recycle of the asphalt to the first stage of the catalytic hydrotreatment.

Canadian Patent Application 2175437 is directed to a process for converting heavy crudes by hydrotreating the crude, distilling the products, deasphalting the high boiling fraction obtained in the distillation and recycling the fraction of the deasphalted stream containing asphaltenes, catalyst in slurry phase and possibly coke to the hydrotreating zone.

Numerous other patent and literature references exist which combine slurry hydroprocessing with solvent deasphalting.

What is needed in the art is an improved process which upgrades heavy feeds economically and effectively.

SUMMARY OF THE INVENTION

An embodiment of the instant invention is directed to a process comprising the steps of:

(a) slurry hydroprocessing (SHP) of a feed under SHP conditions;

(b) deasphalting, under deasphalting conditions the product obtained from said step (a) and recovering a solvent deasphalted oil and solvent deasphalted rock;

(c) calcining said solvent deasphalted rock at a temperature of ≦about 1200° F. to produce an ash catalyst precursor;

(d) recycling said ash catalyst precursor to said step (a).

BRIEF DESCRIPTION OF THE FIGURES

The FIGURE depicts one embodiment of the invention. Feed and hydrogen enter the SHP unit. The product of the SHP unit is passed to a solvent deasphalting unit where paraffinic solvent is added. A deasphalted oil (DAO) is recovered from the top of the unit and deasphalted rock from the bottom. The deasphalted rock is passed to a calciner. Two calciners may be used if desired as shown. In the first calciner, partially burned coke is recycled to act as a carrier for liquid asphalt rock as it is converted to coke. In the second calciner, coke is subjected to a controlled burn to produce ash for recycle as catalyst. The calcined ash is then recycled to the SHP unit for use as the SHP catalyst. A purge line which prevents buildup of solids in the SHP unit is also shown.

DETAILED DESCRIPTION OF THE INVENTION

In a preferred embodiment of the present invention, solvent deasphalted rock (SDR) is fed to a calciner along with hot recycled coke, in the substantial absence of air, whereupon nonvolatile organic fractions and metal containing components of the SDR are converted to coke. As used herein, substantial absence means that no added air is present. A portion of the resultant coke is then fed to a second calciner where controlled burning is carried out to provide a finely divided, metal rich ash for use as catalyst in the SHP reactor. In the first calciner, which acts as a coker, the temperature will range from about 800° F. to 1200° F., preferably from 900° F. to 1100° F. Liquid and gaseous products obtained from the first calciner are recovered and added to the total product pool from the SHP/SDA operation, or burned in part to provide process heat. In the second calciner the controlled burn is carried out below at a temperature at which metal compounds contained in the coke begin to melt, i.e., to form a vitreous mass. Preferably the burn is conducted at or below 1200° F., more preferably below 1100° F. and most preferably below 1000° F. Typically, the calcination will be performed at temperatures of about 800° F. to about 1200° F. Although two calciners are described, a single calciner could be used with a first zone operating in a reducing mode (coking) and second zone in an oxidizing mode (ash production), provided that suitable provisions are made for withdrawal of coking products and for recycle of coke. Suitable provisions are well known to those skilled in the art as are coking conditions.

Alternatively, the SDR may be passed directly to calcination without prior coking.

The calciner is operated at temperatures at or below about 1200° F. (649° C.) to prevent the metals contained in the SDR from sintering. Likewise, the calciner can be coupled via a heat exchanger to provide feed preheat for the SHP, preheat for SDA solvent recovery, or to provide process steam. The feed metals contained in the SDR which are recovered as metal-oxide ash catalyst precursor following calcination of the SDR provide catalyst precursor for the SHP processing step. One skilled in the art will recognize that it may be necessary to activate the ash prior to introducing it into the SHP or in the SHP itself. Activation would include sulfiding the catalyst precursor as necessary. This is readily accomplished by the skilled artisan. The ash catalyst precursor(s) may be sulfided with an $H_2S$ containing gas in situ or from the sulfur species contained in the feed. Ash catalyst precursor may also be sulfided ex-situ, by methods known to the skilled artisan, before entering the SHP unit.

The feeds which may be treated in accordance with the teachings herein are heavy feeds defined as feeds having an API gravity of ≦10 to 15° with a viscosity of ≧60 centistokes at 60° C. and resids such as Arabian Light Vacuum Residuum and Arabian Heavy Vacuum Residuum. Beneficially, the catalyst for conducting the SHP process is provided by the feed being upgraded.

This is very economically beneficial. Thus, the ash catalyst comprises metals or metal compounds inherent to the feed being processed. The catalyst may, therefore, comprise a variety of metals either alone or in conjunction with each other. Thus, the ash catalyst contains one or more metals or metal compounds of vanadium, nickel, iron, molybdenum, etc. Furthermore, the ash catalyst may contain non-indigenous metals or metal compounds utilized to conduct the SHP process until sufficient ash catalyst is accumulated by recycling. By metal compounds is meant compounds containing the specified metals that result from calcination of the SDR such as metal oxides.

In an embodiment of the instant invention (illustrated in FIG. 1), slurry hydroprocessing (SHP) reactor product oil is fed to a deasphalter operated using a $C_3$, $C_4$, $C_5$ paraffin or natural gas condensate, or combinations thereof, at about 275 to about 310° F. at appropriate pressures and times to allow a separation to take place and equilibrium to be achieved thereby allowing for recovery of a deasphalted oil product (DAO) and a solvent deasphalted rock (SDR). The rock is then fed to a calciner (configuration as described) where controlled combustion at a temperature of below 1000° F. is used to generate a metal oxide rich ash that is used as catalyst in the slurry hydroprocessing step. Heat generated during the calcination can be used to generate steam (for process use or facilitating crude oil production) or to preheat feed to the SHP reactor thus reducing preheat furnace requirements for the SHP unit. Metals rejected from the feed can be purged from the process as unused ash to prevent solids build-up in the reactor. In an alternative preferred embodiment, the SDR can first be passed to a coker to recover additional liquid and gaseous product prior to calcination.

In another embodiment of the invention, SDR, or SDR which has undergone coking, can be passed to a boiler to generate steam for the process or for production of crude oil. The metals rich boiler fly ash can then be recovered and used as catalyst for the SHP. Hence, in such an embodiment, the boiler acts as the calciner. Alternatively, metals can be recovered from the ash, by means commonly known in the art, and used (after suitable treatment), such as extraction with various acids, as catalyst precursor for the SHP process.

It will be recognized by the skilled artisan that the ash being utilized as catalyst must contain sufficient quantities of metal to catalyze the SHP process or must be supplemented by additional catalyst. The ash should be used in an amount that is sufficient to provide from about 0.1 to about 5.0 wt % metals based on the feed. Thus, if the ash is to serve as the sole or predominant source of catalyst, the ash will be inventoried until a suitable amount is available for the SHP process. In the meanwhile, the SHP process can be run using a slurry catalyst precursor such as vanadyl oxylate or phosphomolybdic acid which can be discontinued, replaced, or reduced once a suitable quantity of ash is available. (Thus, the SHP step may utilize an initial charge of typical slurry catalyst during start-up and, once sufficient ash catalyst precursor is available, it may be used alone or in conjunction with a start-up catalyst to treat fresh feeds entering the SHP unit.) The concentration of metals on feed, furnished as vanadyl oxalate or as phosphomolybdic acid, will typically range from about 100 to 800 wppm. Catalysts which can be used in the meanwhile can be made in several ways including in situ decomposition of a soluble or dispersible inorganic or organic molybdenum compound in oil. See, for example, the catalyst systems described in U.S. Pat. No. 4,134,825 herein incorporated by reference. Other finely dispersed materials, including multimetallic compounds may also be used provided the quantity of metal is sufficient to keep the toluene insolubles level below 0.5%, and no more than the amount which can be disposed of economically. As used herein precursor means a catalytically effective material which need only undergo activation/sulfiding to function catalytically. General process conditions for SHP include temperatures of about 700° F. to about 850° F. and pressures from about 300 to about 2500 psig for reactor holding times sufficient to attain about 1025+° F. to 1025−° F. conversion of at least about 30%, preferably about 40%, and most preferably from about 50 to 60%. Ash catalyst concentration, expressed as wt % ash metals on feed, will range from about 0.1 wt % to 5.0 wt %, preferably about 0.2 to about 2.0 wt %. Conditions for solvent deasphalting of the SHP product oil will depend on the quality of product desired and are well known to those skilled in the art. However, in a preferred process mode, at least about 80 wt % of SHP product will be recovered as DAO (deasphalted oil).

Deasphalted oil from this process will, in general, be reduced in metals by about 95%, and show a significant reduction in sulfur (50 to 60%)and microcarbon residue (MCR) (60 to 70%) relative to the feed. The DAO may be sent directly to FCC, or blended with VGO before entering the FCC to reduce sulfur and MCR. If desired, the DAO may be sent to a FCC feed hydrotreater to further reduce MCR and sulfur; the advantage is that the DAO will be low enough in metals that hydrotreater catalyst poisoning may not be an issue. Asphalt rock that is not used for catalyst production can be further converted into liquids by thermal processes such as coking, or into synthesis gas via partial oxidation.

The following examples serve to illustrate this invention:

EXAMPLE 1 (SHP with 0.2 wt % ash followed by SDA)

An ash catalyst precursor was prepared by the low temperature calcination (or burn) of a partially gasified fluid coke that had been produced from Boscan crude atmospheric residuum, a material rich in naturally occurring vanadium and nickel compounds. Calcination, carried out at nominal temperature of 850° F., gave a fluffy olive-green powder that contained 45.2 wt % vanadium and 4.5 wt % nickel.

Prior to the SHP test, the ash was pretreated with a 10% hydrogen sulfide in hydrogen stream under 100 psig pressure hydrogen sulfide (1000 psig, 90/10) at 725° F. for 60 minutes, both to sulfide and to activate the catalyst. A mixture of 100 g. of Arabian Light Vacuum Residuum (ALVR) and 0.20 g. of the presulfided ash was charged to a 300 cc autoclave, treated at 775° F. under 1000 psig hydrogen pressure for 2 hours. Hydrogen was flowed through during the test to maintain a hydrogen partial pressure of ca. 900 psig. After cooling to 300° F., the autoclave was vented, and the liquid containing the ash catalyst was vacuum filtered over a #2 Whatman paper. The resultant filter cake was washed with toluene to remove adhering oil and was dried overnight under vacuum. In this manner, there were recovered 87.9 g. of reactor oil and 3.5 g. of solids (toluene insoluble "coke" yield, after adjusting for weight of catalyst, was 3.3 g.). In addition to these materials, there were also recovered 5.4 g. of light liquids (volatilized during the SHP run and collected in a cold high pressure knockout vessel) and 3.0 g. of gaseous products.

The SHP liquid product (excluding light liquid products that were recovered in the high pressure knockout vessel) was then used for the subsequent solvent deasphalting experiment. In a 500 ml round bottle flask, a mixture of 30 g. sample of SHP product and 180 g. of n-pentane was stirred at ambient temperature for overnight. After sitting for 2 hours, the mixture was filtered, and the filtrate was evaporated to remove pentane, followed by drying at 200° F. under vacuum overnight. The yields of deasphalted oil (DAO) and rock were, respectively, 25.3 g. and 4.6 g. DAO was submitted for metals, CCR, sulfur and GCD analyses. Results are shown in Table 1.

EXAMPLE 2 (SHP with 2.1 wt % ash followed by SDA)

An experiment similar to Example 1 was carried out with 100 g. of ALVR and 2.10 g. of the presulfided ash catalyst under the same conditions, except that pressure was increased to 1200 psig. Yields from the SHP reaction were as follows: 93.6 g. of filtered reactor oil, 2.19 g. solids (0.06 g. of toluene insoluble coke after adjusting for catalyst weight), 3.9 g. of light liquid and 1.8 g. of gas.

The pentane deasphalting step, carried out with 30.40 g. of filtered reactor oil, gave 26.14 g. of DAO and 4.35 g. of rock.

EXAMPLE 3

This Example is provided to show that the SHP step of this process can be started up with a catalyst metal that is not native to the feed. Example 1 was repeated using a molybdenum catalyst prepared in accordance with the procedure set out in U.S. Pat. No. 4,470,489. Comparison of the DAO yield and qualities obtained in Example 1 with those of Example 3 (Table 1) illustrate that the Mo and ash catalysts give comparable results, thus illustrating that Mo could be added to the SHP step of the process until such time that the concentration of native metals in the asphalt rock had increased to a level sufficient to provide the necessary level of catalysis.

TABLE 1

Summary of Test Results for Examples 1 to 3

| | ALVR | Example 1 | Example 2 | Example 3 |
|---|---|---|---|---|
| Feed, g. | N/A | 100.3 | 100.1 | 70 |
| Catalyst in reactor, g. | N/A | 0.203 | 2.124 | 0.058 |
| V on feed (supplied as ash) | N/A | 920 ppm | 1.0 wt % | N/A |
| Mo on feed | N/A | N/A | N/A | 250 ppm |
| Pressure, psig | N/A | 1000 | 1200 | 1000 |
| Residence Time, min | N/A | 120 | 120 | 120 |
| SHP Product Yield on SHP Feed | | | | |
| Toluene Insoluble (ex. catalyst), wt % | N/A | 3.3 | 0.06 | |
| Gas, wt % | N/A | 3.0 | 1.8 | 2.6 |
| Light Liquid, wt % | N/A | 5.4 | 3.9 | 2.4 |
| Reactor Oil, wt % | N/A | 87.9 | 93.6 | |
| Quality of SHP Liquid Product (Light Liquid and Reactor Oil) | | | | |
| Ni, ppm | 27.1 | 21.8 | 22.6 | 25 |
| V, ppm | 95.7 | 78.3 | 60.0 | 82 |
| Sulfur, wt % | 4.18 | 3.93 | 3.38 | 3.87 |
| CCR, wt % | 24.3 | 20.7 | 18.0 | 19.0 |
| SHP/SDA Product Yield on SHP Feed | | | | |
| Gas on Feed, wt % | N/A | 3.0 | 1.8 | 2.6 |
| Light Liquid Yield, wt % | N/A | 5.4 | 3.9 | 2.4 |
| DAO (of Reactor Oil) Yield, wt % | 77.5 | 74.7 | 81.0 | 78.9 |
| Rock (of Reactor Oil) Yield, wt % | 22.0 | 13.7 | 13.4 | |
| Yield of Light Liquid + DAO, wt % | 77.5 | 80.1 | 84.9 | 81.3 |
| Yield of Light Liquid + DAO, vol % | 82.0 | 85.3 | 92.0 | |
| Yield of Rock + Toluene Insoluble, wt % | 22.0 | 17.0 | 13.5 | |
| Quality of SHP/SDA Liquid Product (Light Liquid and DAO) | | | | |
| Ni, ppm | 8.6 | 3.6 | 2.3 | 3.4 |
| V, ppm | 30.5 | 4.7 | 5.0 | 5.0 |
| Sulfur, wt % | 3.68 | 3.32 | 3.1 | 3.4 |
| CCR, wt % | 16.2 | 9.26 | 9.17 | 8.25 |

What is claimed is:

1. A process comprising the steps of:

(a) slurry hydroprocessing (SHP) of a feed under SHP conditions;

(b) deasphalting, under deasphalting conditions the product obtained from said step (a) and recovering a solvent deasphalted oil and solvent deasphalted rock;

(c) calcining said solvent deasphalted rock at a temperature of ≦about 1200° F. to produce an ash catalyst precursor;

(d) recycling said ash catalyst precursor to said step (a).

2. A catalyst precursor composition prepared by calcining, at a temperature≦about 1200° F. a solvent deasphalted rock obtained in the solvent deasphalting of a product from SHP of heavy feed wherein said heavy feed has an API gravity of ≦15 with a viscosity of ≧60 centistokes at 60° C.

3. The method according to claim 1 wherein said feed has an API gravity of ≦15 with a viscosity of ≧60 centistokes at 60° C.

4. The method of claim 1 wherein said solvent deasphalted rock is converted to coke at temperatures of about 800 to about 1200° F. prior to said calcination step (c).

5. The process of claim 1 wherein said ash provides from about 0.1 to about 5.0 wt % metals based on the weight of feed.

6. The process of claim 1 wherein said SHP is conducted at temperatures of about 725° to about 850° F. and pressures from about 800 to about 2500 psig.

7. The process of claim 6 wherein conversion of at least about 30% is obtained.

8. The process of claim 1 wherein said calcination step generates heat and said heat is used to generate steam or to preheat said heavy feed in said step (c).

9. The process of claim 1 wherein said ash catalyst is activated prior to said step (c).

10. The process of claim 1 wherein said ash catalyst contains one or more metals or metal compounds of vanadium, nickel, iron or molybdenum.

11. The process of claim 1 wherein the SHP step (a) is conducted using a slurry hydrotreating catalyst and said slurry hydrotreating catalyst is replaced, reduced, or used in conjunction with said ash catalyst precursor of said step (d) as catalyst for said SHP step (a).

12. The process of claim 1 wherein said ash catalyst precursor is activated in situ in said slurry hydroprocessing step.

13. The process of claim 1 wherein said ash catalyst precursor is activated ex-situ prior to recycling to said step (a).

14. A catalyst composition according to claim 2 wherein said catalyst precursor is activated.

15. A catalyst composition according to claim 14 wherein said activation is achieved by sulfiding said catalyst precursor.

* * * * *